US009797071B2

(12) United States Patent
Kim et al.

(10) Patent No.: US 9,797,071 B2
(45) **Date of Patent: *Oct. 24, 2017**

(54) POLYESTER YARN AND PRODUCTION METHOD THEREOF

(75) Inventors: Young-Jo Kim, Gimpo-si (KR); Sang-Mok Lee, Gumi-si (KR); Young-Soo Lee, Gumi-si (KR); Gi-Woong Kim, Daegu (KR)

(73) Assignee: KOLON INDUSTRIES, INC., Gwacheon-Si (KR)

( * ) Notice: Subject to any disclaimer, the term of this patent is extended or adjusted under 35 U.S.C. 154(b) by 225 days.

This patent is subject to a terminal disclaimer.

(21) Appl. No.: 13/994,503

(22) PCT Filed: Dec. 14, 2011

(86) PCT No.: PCT/KR2011/009632
§ 371 (c)(1),
(2), (4) Date: Jun. 14, 2013

(87) PCT Pub. No.: WO2012/081909
PCT Pub. Date: Jun. 21, 2012

(65) Prior Publication Data

US 2013/0267139 A1 Oct. 10, 2013

(30) Foreign Application Priority Data

Dec. 15, 2010 (KR) ..... 10-2010-0128735

(51) Int. Cl.
*D02G 3/44* (2006.01)
*D01F 6/62* (2006.01)
(Continued)

(52) U.S. Cl.
CPC ..... *D02G 3/446* (2013.01); *D01D 5/16* (2013.01); *D01F 6/62* (2013.01); *D02J 1/22* (2013.01);
(Continued)

(58) Field of Classification Search
CPC .. D01D 5/16; D01F 6/62; D02G 3/446; D02J 1/22; D03D 1/02; D10B 2331/04
(Continued)

(56) References Cited

U.S. PATENT DOCUMENTS 4,195,052 A * 3/1980 Davis et al. ..... 264/210.5
4,975,326 A * 12/1990 Buyalos et al. ..... 428/373
(Continued)

FOREIGN PATENT DOCUMENTS

CN 101255612 A 9/2008
CN 101600829 A 12/2009
(Continued)

OTHER PUBLICATIONS

European Patent Office, Extended European Search Report dated Jun. 16, 2014, issued in corresponding European Patent Application No. 11849860.9.
(Continued)

*Primary Examiner* — Arti Singh-Pandey
(74) *Attorney, Agent, or Firm* — Sughrue Mion, PLLC

(57) ABSTRACT

Disclosed is a polyester yarn that can be used in a fabric for an airbag. In particular, a polyester yarn having a diethylene glycol content of 1.1 to 2.5 wt % and initial modulus of 100 g/d or less, a production method thereof, and a fabric for an airbag produced therefrom are disclosed. The polyester yarn has excellent moisture and heat resistance and light resistance, and maintained excellent mechanical properties after long-term aging under high temperature and high humidity conditions. Therefore, when applied to a fabric for an airbag, the polyester yarn provides excellent packing property, shape stability, and gas barrier effect, and the impact applied to a passenger is minimized, thereby safely protecting the passenger at the same time.

24 Claims, 2 Drawing Sheets

(51) Int. Cl.
*D02J 1/22* (2006.01)
*D03D 1/02* (2006.01)
*D01D 5/16* (2006.01)

(52) U.S. Cl.
CPC ..... *D03D 1/02* (2013.01); *D10B 2331/04* (2013.01); *Y10T 442/3976* (2015.04)

(58) Field of Classification Search
USPC ..... 428/357–401; 264/210.8; 57/243; 442/301
See application file for complete search history.

(56) References Cited

U.S. PATENT DOCUMENTS

| | | | | |
|---|---|---|---|---|
| 5,033,523 | A * | 7/1991 | Buyalos et al. | 152/451 |
| 5,097,005 | A * | 3/1992 | Tietz | 528/272 |
| 5,238,740 | A * | 8/1993 | Simons et al. | 428/364 |
| 5,474,836 | A * | 12/1995 | Nishimura | B60R 21/235 280/728.1 |
| 5,547,627 | A * | 8/1996 | Tanaka | D01F 6/62 264/210.5 |
| 5,925,460 | A * | 7/1999 | Hofs et al. | 428/364 |
| 8,153,252 | B2 * | 4/2012 | Lee | 428/364 |
| 8,822,358 | B2 * | 9/2014 | Kim | B60R 21/235 139/383 R |
| 2002/0088419 | A1 * | 7/2002 | Wisnia et al. | 123/179.2 |
| 2005/0106388 | A1 | 5/2005 | Konishi et al. | |
| 2005/0153609 | A1 | 7/2005 | Keshavaraj | |
| 2010/0275568 | A1 | 11/2010 | Chikatsune et al. | |
| 2012/0040168 | A1 * | 2/2012 | Engbrecht et al. | 428/221 |
| 2012/0043742 | A1 * | 2/2012 | Kim et al. | 280/730.2 |
| 2013/0040522 | A1 * | 2/2013 | Kim et al. | 442/181 |
| 2013/0090032 | A1 * | 4/2013 | Kim et al. | 442/301 |
| 2013/0187367 | A1 * | 7/2013 | Kim et al. | 280/743.1 |
| 2013/0224468 | A1 * | 8/2013 | Kim et al. | 428/221 |

FOREIGN PATENT DOCUMENTS

| | | | |
|---|---|---|---|
| EP | 0280026 | A2 | 8/1988 |
| EP | 0 666 344 | A1 | 8/1995 |
| EP | 1690881 | A1 | 8/2006 |
| EP | 2233510 | A1 | 9/2010 |
| JP | 4-214437 | A | 8/1992 |
| JP | 7-48717 | A | 2/1995 |
| JP | 07-090746 | A | 4/1995 |
| JP | 2007-182646 | A | 7/2007 |
| KR | 0173494 | B1 | 2/1999 |
| KR | 1020100112605 | A | 10/2010 |
| KR | 1020100117022 | A | 11/2010 |
| WO | 2007/015617 | A1 | 2/2007 |

OTHER PUBLICATIONS

International Searching Authority, International Search Report for PCT/KR2011/009632 dated Jun. 29, 2012.

* cited by examiner

POLYESTER YARN AND PRODUCTION METHOD THEREOF

CROSS REFERENCE TO RELATED APPLICATIONS

This application is a National Stage of International Application No. PCT/KR2011/009632 filed Dec. 14, 2011, claiming priority based on Korean Patent Application No. 10-2010-0128735 filed Dec. 15, 2010, the contents of all of which are incorporated herein by reference in their entirety.

BACKGROUND OF THE INVENTION (a) Field of the Invention

The present invention relates to a polyester yarn which can be used in a fabric for an airbag, and more particularly, to a high-strength and low-modulus polyester yarn which has excellent mechanical properties, shape stability, packing property or the like, and a production method thereof, and a fabric for an airbag using the same.

(b) Description of the Related Art

Generally, an airbag is a device for protecting a driver and passengers, in which a crash impact is detected by an impact detecting sensor when driving vehicles collide head-on at a speed of about 40 km/h or higher, and consequently, gunpowder explodes to supply gas into an airbag cushion to inflate the airbag. A general structure of an airbag system is depicted in FIG. 1.

As depicted in FIG. 1, the conventional airbag system includes: an inflator 121 that generates a gas by ignition of a detonator 122; an airbag module 100 that includes an airbag 124 that is expanded and unfolded toward a driver on the driver's seat by the generated gas, and is installed in a steering wheel 101; an impact sensor 130 that gives an impact signal when the vehicle has crashed; and an electronic control module 110 that ignites the detonator 122 of the inflator 121 according to the impact signal. In such airbag system, the impact sensor 130 detects the impact and sends the signal to the electronic control module 110 when the vehicle collides head-on. At this time, the electronic control module 110 that received the signal ignites the detonator 122 and a gas generator in the inflator 121 is combusted. The combusted gas generator rapidly generates the gas to expand the airbag 124. The expanded airbag 124 contacts the front upper body of the driver and partially absorbs the impact load caused by the collision, and when the driver's head and chest go forward according to the law of inertia and smash against the airbag 124, it further absorbs the shock toward the driver by rapidly discharging the gas from the airbag 124 through discharging holes formed on the airbag 124. Therefore, the airbag effectively absorbs the shock that is delivered to the driver at the time of a collision, and can reduce secondary injuries.

As disclosed above, an airbag used in a vehicle is prepared in a certain shape and is installed in the steering wheel, door roof rails, or side pillars of the vehicle in a folded form so as to minimize its volume, and it is expanded and unfolded when the inflator 121 operates.

Therefore, it is very important that the airbag has folding property and flexibility for reducing the shock to the occupant in addition to good mechanical properties of the fabric for effectively maintaining the folding and packaging properties of the airbag when it is installed in a vehicle, preventing damage to and rupture of the airbag itself, providing good unfolding properties of the airbag cushion, and minimizing the impact provided to the occupant. However, an airbag fabric that can maintain superior air-tightness and flexibility for the occupant's safety, sufficiently endure the impact applied to the airbag, and be effectively installed in a vehicle has not yet been suggested.

Previously, a polyamide fiber such as nylon 66 or the like has been used as the raw material of the fiber for an airbag. However, nylon 66 has superior impact resistance but has drawbacks of being inferior to polyester fiber in terms of moisture and heat resistance, light resistance, and shape stability, and being expensive.

Meanwhile, Japanese patent publication No. Hei 04-214437 suggested the use of a polyester fiber for reducing such defects. However, when the airbag was prepared by using the prior polyester yarn, it was difficult to install the airbag in a narrow space in a vehicle because of its high modulus, and there was a limitation for maintaining sufficient mechanical and unfolding properties under severe conditions of high temperature and high humidity.

Therefore, it is needed to develop a fiber yarn that maintains superior shape stability and gas barrier effect so as to be suitably used as a fabric for an airbag, and also maintains flexibility for reducing the impact applied to passengers, the packing property, and superior mechanical properties under severe conditions of high temperature and high humidity.

SUMMARY OF THE INVENTION

It is an aspect of the present invention to provide a polyester yarn that secures superior shape stability, flexibility, and packing property so as to be used in a fabric for an airbag, and maintains sufficient performance under severe conditions of high temperature and high humidity.

It is another aspect of the present invention to provide a method of producing the polyester yarn.

It is still another aspect of the present invention to provide a fabric for an airbag that is produced by using the polyester yarn.

The present invention provides a polyester yarn having a diethylene glycol content of 1.1 to 2.65 wt %, and an initial modulus of 100 g/d or less.

Further, the present invention provides a method for producing a polyester yarn, including the steps of melt-spinning a polyester polymer having intrinsic viscosity of 0.85 dl/g or more at 270 to 300° C. so as to prepare an undrawn polyester yarn, and drawing the undrawn polyester yarn.

Further, the present invention provides a fabric for an airbag that is produced by the using the polyester yarn.

The present invention provides a polyester yarn having a diethylene glycol content of 1.1 to 2.65 wt % and an initial modulus of 100 g/d or less.

Further, the present invention provides a method for producing the polyester yarn, including the steps of melt-spinning a polyester polymer having intrinsic viscosity of 0.85 dl/g or more at 270 to 300° C. so as to prepare an undrawn polyester yarn, and drawing the undrawn polyester yarn.

Further, the present invention provides a fabric for an airbag that is produced by using the polyester yarn.

DETAILED DESCRIPTION OF THE EMBODIMENTS

Figure 1:
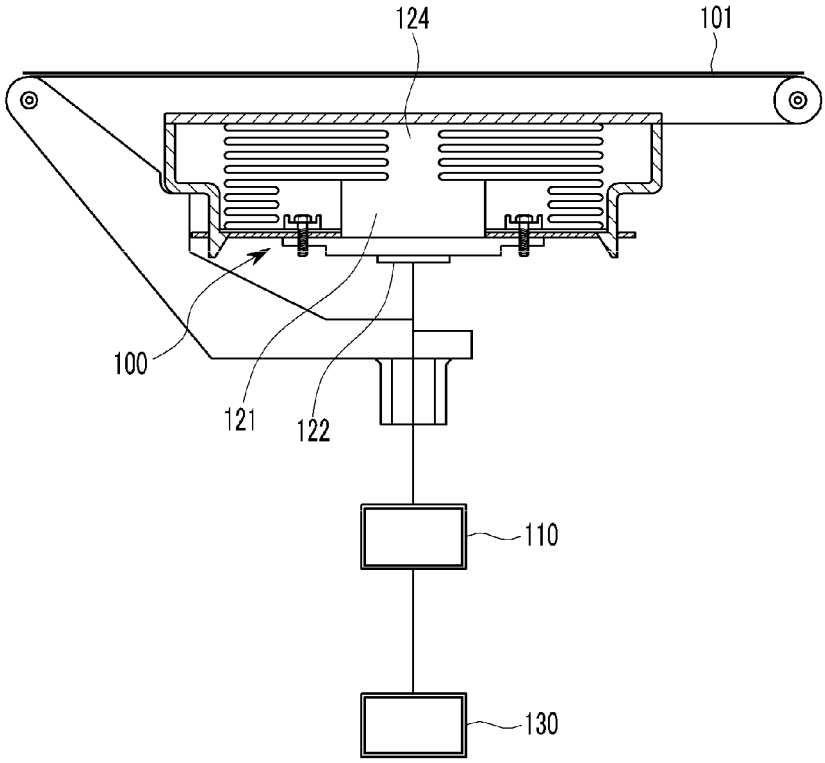
FIG. 1 is a view of a general airbag system.

Hereinafter, a polyester yarn according to specific embodiments of the present invention, a production method thereof, and a fabric for an airbag produced therefrom will be described in more detail. However, these are set forth to illustrate the present invention, and the scope of the present invention is not limited thereto. It will be obvious to those skilled in the art that various modifications and changes are possible within the scope of the present invention.

Additionally, as long as not particularly described in the entire specification, "includes" or "contains" means to include any component (or constituent) without particular limitation, and the addition of another component (or constituent) is not excluded.

A polyester fabric for an airbag may be produced by melt-spinning a polymer containing polyethylene terephthalate (hereinafter, referred to as "PET") to prepare an undrawn yarn, drawing the undrawn yarn to obtain a drawn yarn (namely, yarn), and weaving the polyester yarn. Therefore, the characteristics of the polyester yarn are directly or indirectly reflected in the physical properties of a polyester fabric for an airbag.

Particularly, in order to apply the polyester to the fiber for an airbag instead of the prior polyamide fiber such as nylon 66 or the like, the disadvantages of the prior polyester yarns such as a low folding property due to its high modulus and stiffness, a reduction in physical properties under severe conditions of high temperature and high humidity due to its low melt heat capacity, and a decline in unfolding performance thereby must be overcome.

Polyester has a stiffer structure than nylons in terms of molecular structure, and thus has a characteristic of high modulus. Therefore, the packing property remarkably deteriorates, when it is used in a fabric for an airbag and installed in a vehicle. Furthermore, carboxyl end groups (hereinafter, referred to as "CEG") in the polyester molecular chain attack ester bonds under high-temperature and high-humidity conditions to cut the chain, and it causes deterioration of the physical properties after aging.

Accordingly, the polyester yarn of the present invention can be effectively applied to the fabric for an airbag, because the excellent mechanical properties such as toughness can be maintained while the stiffness is remarkably lowered and a reduction in physical properties is lowered during long-term storage by optimizing the range of the physical properties such as diethylene glycol (DEG) content, initial modulus or the like.

Particularly, the results of the present inventor's experiments revealed that a fabric for an airbag shows more improved folding property, shape stability, and gas barrier effect by preparing the fabric for an airbag from the polyester yarn having the predetermined characteristics. When installed in a vehicle, the fabric for an airbag can maintain superior packing property, superior mechanical properties, air-leakage protection, air-tightness or the like, even under severe conditions of high temperature and high humidity.

According to one embodiment of the present invention, the present invention provides a polyester yarn having the predetermined characteristics. The polyester yarn may have a diethylene glycol content of 1.1 to 2.65 wt % and an initial modulus of 100 g/d or less.

It is preferable that the polyester yarn includes poly (ethylene terephthalate) (PET) as a main component. In this regard, various additives may be included in the PET during the production steps thereof, and thus the yarn may include at least 70 mol % or more, and more preferably 90 mol % or more, in order to show the physical properties suitable for the fabric for an airbag. Hereinafter, the term PET means a polymer including PET of 70 mol % or more unless any special explanation is given.

The polyester yarn according to one embodiment of the present invention is produced under the after-mentioned polymerization, melt-spinning and drawing conditions so as to exhibit the characteristics of the diethylene glycol content of 1.1 to 2.65 wt % and the initial modulus of 100 g/d or less.

In particular, the polyester yarn of the present invention may have the diethylene glycol content, namely, the DEG content of 1.1 to 2.65 wt %, preferably 1.15 to 2.6 wt %, and more preferably 1.2 to 2.5 wt %, in order to secure excellent physical properties suitable for the fabric for an airbag. In order to secure excellent strength and elongation and packing property of the fabric owing to high strength, high elongation and high contraction properties of the polyester yarn when applied to the fabric for an airbag, the DEG content should be 1.1 wt % or more. In particular, if the DEG content is less than 1.1 wt %, the initial modulus is increased to deteriorate the packing property of the airbag and reeling property, leading to deterioration in the basic physical properties and productivity, because the basic molecular chain of the polyester yarn is rigid. If the DEG content is more than 2.65 wt %, it is difficult to achieve the physical properties of high-strength and high-elongation, and thermal stability is reduced to cause a problem in heat resistance upon unfolding the airbag. Therefore, the polyester yarn for an airbag according to the present invention may have the DEG content of 2.65 wt % or less.

As the polyester yarn maintains the optimized diethylene glycol content, it has a much lower content of carboxyl end group (CEG) than the previously known polyester yarns. That is, the polyester yarn may have the CEG content of 40 meq/kg or less, preferably 30 meq/kg or less, and more preferably 20 meq/kg or less. The carboxyl end group (CEG) in a molecular chain of polyester attacks an ester bond under conditions of high temperature and high humidity to cause the molecular chain to be cut, thereby deteriorating the physical properties of the polyester yarn after aging. In the present invention, the diethylene glycol content of the polyester yarn is optimized to be 1.1 wt % or more, so as to minimize formation of carboxyl end groups in the molecule and to prevent a reduction in physical properties according to molecular chain cleavage under severe conditions when applied to the fabric for an airbag. In particular, if the CEG content is more than 40 meq/kg, an ester bond is cleaved by CEG under a condition of high humidity to cause a reduction in the physical properties of the fabric, when applied to an airbag. Thus, it is preferable that the CEG content is 40 meq/kg or less.

Also, the polyester yarn of the present invention is characterized in that it is optimized to have low initial modulus together with high diethylene glycol content. That is, the polyester yarn may have an initial modulus of 100 g/d or less, or 40 to 100 g/d, preferably 97 g/d or less, or 50 to 97 g/d, and more preferably 95 g/d or less, or 60 to 95 g/d.

The polyester generally has higher stiffness than nylons due to its molecular structure and shows a characteristic of high modulus. Therefore, when the polyester is used in the fabric for an airbag, it is difficult to install the airbag in a narrow space of a vehicle because the folding and packing properties remarkably deteriorate. However, the polyester yarn obtained through the controlled melt-spinning and drawing process shows the characteristics of high strength and low modulus, and shows a lower initial modulus of 100 g/d or less, which is lower than that of the previously known industrial polyester yarns. In this regard, the modulus of the polyester yarn means a coefficient value of elasticity that is obtained from the slope in the linear elastic region of the stress-strain curve obtained by a tensile test and corresponds to an elasticity value indicating a degree of elongation and a degree of deformation when the fiber is stretched by its both side ends. Furthermore, the initial modulus of the yarn means a coefficient value of elasticity at an approximate starting point of the elastic range after "0" point in the stress-strain curve. When the initial modulus of the yarn is high, the elasticity is good but the stiffness of the fabric may become poor. When the initial modulus is too low, the stiffness of the fabric is good but the elastic recovery becomes low and the toughness of the fabric may become poor. The initial modulus of the polyester yarn of the present invention is optimized in a much lower range than that of the prior polyester yarns for the industrial applications. As such, since the fabric for an airbag is produced from the polyester yarn having a lower initial modulus than those of the prior yarns, the fabric can resolve the problem of the high stiffness of the prior polyester fabric, and then can exhibit superior folding, flexibility, and packing properties.

In addition to the low initial modulus, the polyester yarn is characterized in that it is minimally drawn. The elongation of the polyester yarn may be 0.5% or more, or 0.5% to 1.5%, and preferably 0.7% to 1.2% at a stress of 1.0 g/d; 4.3% or more, or 4.3% to 20%, and preferably 4.3% to 15% at a stress of 4.0 g/d; and 7.5% or more, or 7.5% to 25%, and preferably 7.5% to 20% at a stress of 7.0 g/d, at room temperature. Owing to these characteristics, the fabric for an airbag produced from the polyester yarn can have superior strength and elongation and packing property to the prior polyester fabric.

Simultaneously, the polyester yarn may have improved intrinsic viscosity compared to that of the previously known polyester yarn. That is, the polyester yarn may have an intrinsic viscosity of 0.8 dl/g or more, or 0.8 to 1.2 dl/g, preferably 0.85 to 1.15 dl/g, and more preferably 0.90 dl/g to 1.10 dl/g. Preferably, the intrinsic viscosity of the polyester yarn may be maintained within the range such that the polyester yarn is not thermally deformed during a coating process for forming the polyester yarn into an airbag.

Only when the intrinsic viscosity of the yarn is 0.8 dl/g or more, the elongation of the polyester yarn becomes low, thus satisfying the required high strength of a fabric for an airbag, and otherwise, the elongation thereof becomes high, thus not exhibiting the physical properties. As such, when the elongation of the polyester yarn is high, the degree of orientation thereof increases such that the fiber may have a high modulus. Therefore, it is preferred that the intrinsic viscosity of the yarn is maintained at 0.8 dl/g or more such that the elongation thereof become low, thus realizing a fabric having a low modulus. Further, when the viscosity of the yarn is more than 1.2 dl/g, the tension increases during elongation, thereby causing process problems, and thus it is more preferred that the viscosity thereof is 1.2 dl/g or less. Particularly, when the intrinsic viscosity of the polyester yarn of the present invention is maintained high, the elongation thereof becomes low, thus allowing a fabric for an airbag to have high strength characteristics such as sufficient mechanical properties, impact resistance and toughness as well as to have low stiffness.

Therefore, it is possible to produce a fabric for an airbag exhibiting excellent mechanical properties, packing property, shape stability, impact resistance and gas barrier effect at the same time by using the polyester yarn having the high diethylene glycol content and the low initial modulus, preferably, the polyester yarn having the low CEG content, the high elongation, high contraction rate, and high intrinsic viscosity together with such diethylene glycol content and initial modulus. Accordingly, when this polyester yarn is used, a fabric for an airbag having excellent impact resistance, shape stability, mechanical properties, air-tightness as well as lower stiffness, folding property, flexibility, packing property can be obtained. Such a polyester fabric for an airbag exhibits excellent mechanical properties, shape stability and gas barrier effect, provides excellent folding property and packing property to an airbag at the same time when the airbag mounted in the narrow space of an automobile, and allows an airbag to have high flexibility to minimize the impact applied to a passenger, thus safely protecting the passenger. Therefore, the polyester fabric can be preferably applied to the fabric for an airbag, or the like.

Meanwhile, the polyester yarn according to one embodiment of the present invention may have a tensile strength of 6.5 g/d or more, or 6.5 g/d to 11.0 g/d, preferably 7.5 g/d or more, or 7.5 g/d to 10.0 g/d, and a breaking elongation of 13% or more, or 13% to 35%, preferably 15% or more, or 15% to 25%. The yarn may have a dry contraction ratio of 4.0% or more, or 4.0% to 12.0%, preferably 4.1% to 11%, and more preferably 4.2% to 10.0%. The yarn may have a toughness of $30\times10^{-1}$ g/d or more, or $30\times10^{-1}$ g/d to $46\times10^{-1}$ g/d, preferably $31\times10^{-1}$ g/d or more, or $31\times10^{-1}$ g/d to $44\times10^{-1}$ g/d. As described above, when the diethylene glycol content and the initial modulus are optimized, the polyester yarn of the present invention can secure excellent physical properties such as high elongation and stiffness, and can exhibit excellent performance when it is formed into a fabric for an airbag.

Preferably, the polyester yarn of the present invention may have a contraction stress of 0.005 to 0.075 g/d at 150° C. corresponding to a laminate coating temperature of a general coating fabric, and may have a contraction stress of 0.005 to 0.075 g/d at 200° C. corresponding to a sol coating temperature of a general coating fabric. That is, when each of the contraction stresses at 150° C. and 200° C. is 0.005 g/d or more, it is possible to prevent a fabric from becoming slack by heat during a coating process, and when each of the contraction stresses at 150° C. and 200° C. is 0.075 g/d or less, the relaxation stress of a fabric can be decreased when the fabric is cooled at room temperature after the coating process. The contraction stress is based on the value measured under a fixed load of 0.10 g/d.

As such, in order to prevent the deformation during a heat treatment process such as a coating process or the like, the polyester yarn may have a crystallinity of 40% to 55%, preferably 41% to 52% and more preferably 41% to 50%. When the yarn is applied to the fabric for an airbag, the crystallinity of the yarn must be 40% or more in order to maintain the thermal shape stability of the fabric. When the crystallinity thereof is more than 55%, there is a problem in that the impact absorbing performance of the fabric is deteriorated because its noncrystalline region is decreased. Therefore, it is preferred that the crystallinity of the polyester yarn is 55% or less.

Further, the single yarn fineness of the polyester yarn may be 0.5 to 20 denier, and preferably 2.0 to 10.5 denier. The polyester yarn must maintain low fineness and high strength in terms of packing property so that the polyester yarn is effectively used in the fabric for an airbag. Accordingly, the total fineness of the yarn may be 200 to 1000 denier, preferably 220 to 840 denier, and more preferably 250 to 600 denier. Furthermore, it is preferable that the number of filaments of the yarn may be 50 to 240, preferably 55 to 220, and more preferably 60 to 200, because a greater number of filaments of the yarn can give a softer touch but too many filaments are not good in terms of spinnability.

Meanwhile, the above-mentioned polyester yarn according to an embodiment of the present invention may be produced by a method including the steps of melt-spinning polyester polymers, for example, PET chips to prepare an undrawn yarn, and drawing the undrawn yarn. As described above, a polyester yarn having the above-mentioned physical properties can be produced by directly and indirectly reflecting the specific conditions or procedures of each step in the physical properties of the polyester yarn.

Particularly, it is revealed that it is possible to secure the polyester fiber for an airbag having a diethylene glycol content of 1.1 to 2.65 wt % and an initial modulus of 100 g/d or less through the optimization of the processes. It is also revealed that it is possible to minimize the content of carboxyl end group (CEG) through optimization of the melt-spinning and drawing processes, which exists as an acid under a high humidity condition to cause scission of basic molecular chains of the polyester yarn. Therefore, such polyester yarn shows a low initial modulus and a high diethylene glycol content range at the same time, and may be preferably applied to the fabric for an airbag having superior mechanical properties, packing property, shape stability, impact resistance, and gas barrier effect.

Hereinafter, a method of producing the polyester yarn will be described in more detail with respect to each step.

The method of producing the polyester yarn for an airbag includes the steps of: melt-spinning a polyester polymer having an intrinsic viscosity of 0.85 dl/g or more at 270 to 310° C. to prepare an undrawn polyester yarn; and drawing the undrawn polyester yarn.

First, the melt-spinning and drawing processes according to the present invention will be briefly described with reference to the attached drawings such that it can be easily carried out by a person with ordinary skill in the related art.

Figure 2:
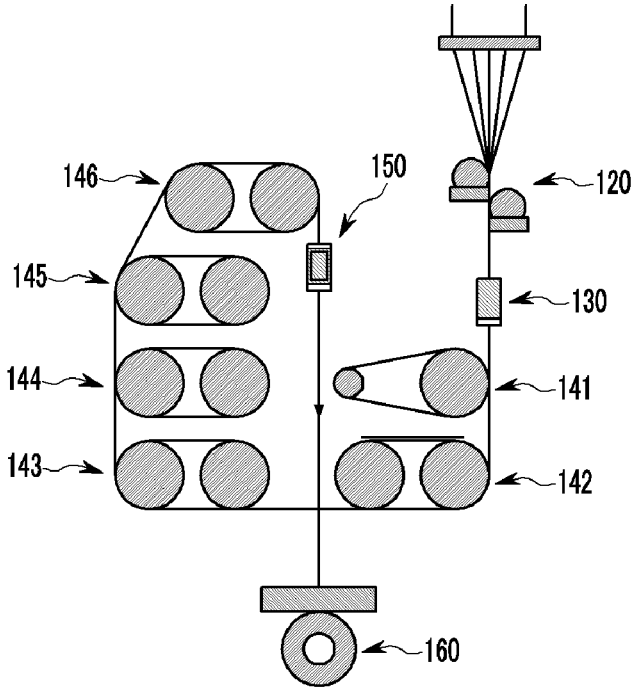
FIG. 2 is a schematic view showing a process of producing a polyester yarn according to an embodiment of the present invention.

FIG. 2 is a schematic view showing a process of producing a polyester yarn, including the melt-spinning and drawing steps, according to an embodiment of the present invention. As shown in FIG. 2, in the method of producing the polyester yarn for an airbag of the present invention, the polyester polymer prepared in the above described manner is melted, the molten polymer is spun by a spinning nozzle and cooled by quenching air, an emulsion is provided to the undrawn yarn using an emulsifying roll (or oil jet) 120, and then the emulsion provided to the undrawn yarn is uniformly dispersed at a predetermined pressure using a pre-interlacer 130. Subsequently, the undrawn yarn is drawn by multi-step drawing rollers 141 to 146, the drawn yarns are intermingled at a predetermined pressure by a second interlacer 150, and then the intermingled drawn yarn is rolled by a winding roller 160, so as to produce a yarn.

Meanwhile, in the method of the present invention, first, a high-viscosity polyester polymer may be prepared and used, in order to produce a high-strength and low-modulus polyester yarn that can be effectively used in the fabric for an airbag. In particular, process conditions of polycondensation and solid state polymerization for producing the polyester polymer must be optimized, in order to maintain excellent physical properties under severe conditions of high temperature and high humidity when applied to the yarn for an airbag in the present invention. Particularly, a polymerization method of dicarboxylic acid and glycol (hereinafter, referred to as "TPA process") is optimized and applied to the polyester polymer, and the content of diethylene glycol (DEG, Di-Ethylene Glycol) is optimized and high intrinsic viscosity and minimal formation of carboxyl end group (CEG, Carboxyl End Group) can be achieved.

First, the method of producing the polyester polymer by esterification of dicarboxylic acid and diol may include the steps of: a) carrying out an esterification reaction of dicarboxylic acid and glycol, b) carrying out a polycondensation reaction of the oligomers produced from the esterification reaction, and c) carrying out a solid state polymerization of the polymers produced from the polycondensation reaction.

In the production process of the polyester polymer, the polycondensation reaction and the solid state polymerization are carried out, considering optimal temperature conditions and reaction time for favorable DEG production and minimal CEG formation, thereby securing excellent mechanical properties after long-term aging under severe conditions of high temperature and high humidity. More particularly, for favorable DEG production and minimal CEG formation in melt polymerization and solid state polymerization of the polymer, the polycondensation reaction can be carried out at a temperature range of 245 to 310° C., and then the solid state polymerization can be carried out at a temperature range of 200 to 250° C. The high-DEG and low-CEG polymers thus produced are used to produce a polyester yarn showing high strength, high elongation, high contraction rate, and low reduction in physical properties upon long-term aging, which is applicable to the fabric for an airbag.

In the polyester production process of the present invention, the dicarboxylic acid may be one or more selected from the group consisting of an aromatic dicarboxylic acid having 6 to 24 carbon atoms, a cycloaliphatic dicarboxylic acid having 6 to 24 carbon atoms, an alkane dicarboxylic acid having 2 to 8 carbon atoms, and ester-forming derivatives thereof. More particularly, the dicarboxylic acid or the ester-forming derivative that can be used for producing the polyester yarn of the present invention may be aromatic dicarboxylic acid having 6-24 carbon atoms such as terephthalic acid, isophthalic acid, biphenyl dicarboxylic acid, 1,4-naphthalene dicarboxylic acid, 1,5-naphthalene dicarboxylic acid or the like, and ester-forming derivatives thereof, cycloaliphatic dicarboxylic acid having 6-24 carbon atoms such as 1,4-cyclohexane dicarboxylic acid or the like, and alkane dicarboxylic acid having 2 to 6 carbon atoms or the like.

Among them, terephthalic acid is preferably used, considering economics and the properties of the complete product. Particularly, the dicarboxylic acid including 70 mol % or more of terephthalic acid is preferably used, when one or more compounds are used as the dicarboxylic acid.

Furthermore, the glycol usable in the present invention may be one or more selected from the group consisting of alkane diol having 2-8 carbon atoms, cycloaliphatic diol having 6-24 carbon atoms, aromatic diol having 6-24 carbon atoms, and an ethylene oxide or propylene oxide adduct thereof. More particularly, the glycol that can be used for producing the polyester of the present invention may be alkane diol having 2-8 carbon atoms such as ethylene glycol, 1,2-propane diol, 1,3-propane diol, 1,3-butane diol, 1,4-butane diol, 1,5-pentane diol, 1,6-hexane diol or the like, cycloaliphatic diol having 6-24 carbon atoms such as 1,4-cyclohexane diol, 1,4-cyclohexane dimethanol or the like, aromatic diol having 6-24 carbon atoms such as bisphenol A, bisphenol S or the like, and an ethylene oxide or propylene oxide adduct of the aromatic diol or the like.

As described above, the polyester polymer of the present invention can be produced by application of a terephthalic acid (TPA) method including esterification of a dicarboxylic acid and a diatomic alcohol, glycol. A general polyester TPA method is a direct reaction of the dicarboxylic acid and the glycol, and is a self acid-catalyzed reaction without using other catalysts in the esterification reaction. For example, poly(ethylene terephthalate) (PET) may be directly prepared by the esterification reaction of terephthalic acid and ethylene glycol, as shown in the following Reaction scheme 1.

[Reaction scheme 1]

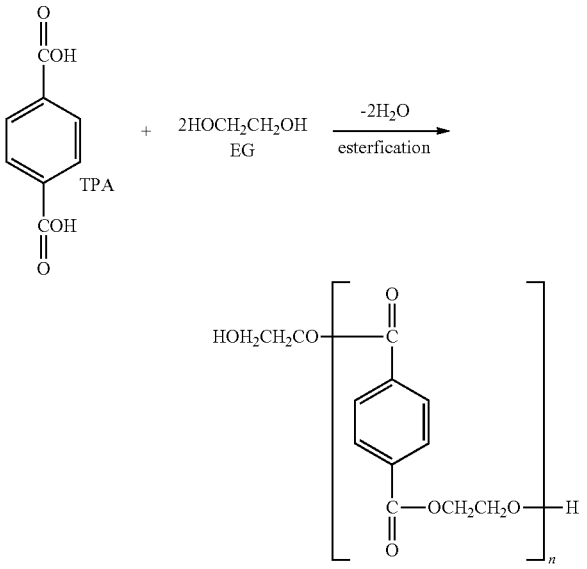

PET

In the TPA reaction, it is needed to maintain a high temperature because of the insolubility and low reactivity of the dicarboxylic acid. The oligomer prepared by the above method can be polymerized into a polymer having a specific viscosity by carrying out a polycondensation reaction at a high temperature while adding a catalyst under a high vacuum condition. The prepared polymer is discharged through a nozzle by using a gear pump or a high pressure inert gas ($N_2$). The discharged polymer is solidified in cooling water and cut into an adequate size.

When the polyester is produced by the conventional TPA method, the final polyester polymer prepared has plenty of carboxyl end groups, because the esterification and polycondensation reactions at a high temperature cause thermal degradation and generate carboxyl end groups and the dicarboxylic acid having carboxyl end groups is used as the raw material. Furthermore, when the polyester yarn having plenty of carboxyl end groups is applied to the fabric for an airbag, the carboxyl end group that exists as an acid under the high temperature and high humidity conditions causes the scission of the molecular chain and deteriorates the properties of the fabric, as disclosed above.

In the present invention, therefore, the glycol content is increased, that is, a molar ratio of glycol/dicarboxylic acid (G value) is increased in the polycondensation of dicarboxylic acid and glycol so as to secure a desired level of DEG and to reduce CEG at the same time, and a low-temperature solid state polymerization is carried out by optimizing the solid state polymerization in the mild conditions to additionally bind the carboxyl end group with the hydroxyl group, thereby reducing the CEG content and increasing a molecular weight of the polymer at the same time.

The esterification reaction of dicarboxylic acid and glycol a) may be carried out according to a conventional method known as the TPA method, and is not particularly limited to special processing conditions.

According to one embodiment of the present invention, however, the mole ratio of dicarboxylic acid and glycol in step a) may be 1:1 to 1:4, preferably 1:1.1 to 1:1.35, and more preferably 1:1.1 to 1:1.3. Preferably, the mole ratio of the reactants is optimized and maintained in the above range, considering reaction time and CEG and DEG contents of the polymer.

The esterification reaction of step a) may be carried out at a temperature of 230 to 310° C. and preferably 250 to 290° C., and the reaction time may be 2 to 5 hours, and preferably 3 to 4 hours. At this time, the reaction time and the reaction temperature may be controlled, considering the reaction time and the number of rings of the oligomer.

Furthermore, the polycondensation reaction of step b) may be carried out at a temperature of 245 to 310° C., and preferably 250 to 300° C. under a pressure of 2 Torr or less, and preferably 1 Torr or less. At this time, the reaction time may be 2 to 5, hours, and preferably 3 to 4 hours. The reaction time and the reaction temperature may be controlled, considering CEG and DEG contents of the polymer and viscosity of the final polymer melt.

In particular, the viscosity of the polymer melt can be controlled in a proper range through the polycondensation reaction of step b), and the polymer produced after the polycondensation is controlled to have an intrinsic viscosity of preferably 0.45 to 0.85 dl/g, and more preferably of 0.45 to 0.80 dl/g, in terms of solid state polymerization of the polymer.

After the polycondensation reaction, it is possible to block the carboxyl end group in the produced polymer and to increase the molecular weight of the final polymer using the produced hydroxyl end groups at the same time, and to increase the DEG content by further reaction of DEG and glycol end groups, by further adding glycol therein and carrying out the additional reaction under reduced pressure, as described above. In other words, the present invention may further include the step of further adding glycol and carrying out the reduced pressure reaction, after the polycondensation reaction of step b).

The glycol in the reduced pressure reaction may be further added in an amount of 0.001 to 20% by weight, preferably 0.01 to 15% by weight, and more preferably 0.01 to 10% by weight, based on the total weight of the glycol added in step a), and it is preferable that the amount of the glycol further added is maintained in the above range, in terms of improvement of physical properties and productivity of the polymer.

Furthermore, the additional introduction of the glycol may be carried out while maintaining a normal pressure, and the additional reaction may be carried out under reduced pressure after further addition of the glycol. The additional reaction may be carried out under a reduced pressure of 1 to 10 Torr, and preferably 0 to 5 Torr. It is preferable that the pressure is maintained in the above range, in terms of improvement of physical properties and productivity of the polymer.

The reduced pressure reaction may be carried out by further adding glycol immediately after the vacuum state is broken to maintain the normal pressure, after the polycondensation reaction of step b). The reaction temperature may vary depending on the reduced pressure conditions. Furthermore, the reaction time for the additional introduction of glycol may be 5 minutes to 1 hour, and preferably 5 to 30 minutes. In this regard, the reaction time and the reaction temperature may be controlled in terms of improvement of physical properties and productivity of the polymer.

After further addition of the glycol and the reduced pressure reaction, the produced polyester polymers (chips), namely, melt-polymerized polymer chips, may have the intrinsic viscosity of 0.4 dl/g or more, or 0.4 to 0.9 dl/g, and preferably 0.5 dl/g or more, or 0.5 to 0.9 dl/g, which is preferable in terms of improvement of physical properties of the polymer.

Further, after the polycondensation reaction of step b) or further reduced pressure reaction, the produced polymers may be used by minimizing the size of the chip, namely, by increasing the specific surface area of the chip, in order to minimize the difference between internal/external reactions in the next solid state polymerization step and to increase the reaction rate. Preferably, the polymers produced after the polycondensation reaction of step b) may be cut into a chip size of 1.0 g/100 ea to 3.0 g/100 ea and more preferably 1.5 g/100 ea to 2.5 g/100 ea, and then used in the solid state polymerization, in order to increase the specific surface area.

The solid state polymerization reaction of step c) may be carried out at a temperature of 200 to 250° C., and preferably 220 to 235° C., and at a pressure of 2 Torr or lower, and preferably 1 Torr or lower. The reaction time may be 10 hours or longer, and preferably 15 hours or longer. The reaction time and the reaction temperature may be controlled, considering the final viscosity and the CEG content of the chip.

In the present invention, the polycondensation reaction of the melt polymerization of step b) is carried out under more mild conditions of a low temperature, and the solid state polymerization is carried out as a further reaction at the same time, so that the produced carboxyl end group (CEG) is bound with the hydroxyl group to reduce the CEG content and to increase the molecular weight of the polymer.

The polyester polymer (chip) produced by the solid state polymerization of step c) may have the intrinsic viscosity of 0.7 dl/g or more, or 0.7 to 2.0 dl/g, preferably 0.85 dl/g or more, or 0.85 to 2.0 dl/g, and more preferably 0.90 dl/g or more, or 0.90 dl/g to 2.0 dl/g, which is preferable in terms of improvement of the physical properties of the yarn and the spinnability. When the intrinsic viscosity of the chip is 0.7 dl/g or more, the yarn having the preferred characteristics of high strength and high breaking elongation can be produced. When the intrinsic viscosity of the chip is 2.0 dl/g or less, the scission of the molecular chain due to the increasing melting temperature of the chip and the pressure increase in the spinning pack can be prevented.

However, as disclosed above, in order to produce the polyester yarn having high strength and low modulus, it is preferred that, in a process of preparing an undrawn yarn, a high-viscosity polyester polymer, for example, a polyester polymer having an intrinsic viscosity of 0.85 dl/g or more is used to maintain high viscosity, thereby effectively exhibiting high strength at a low draw ratio, and thus effectively decreasing the modulus. Further, in order to prevent the molecular chain of the polyester polymer from being cut by the increasing melting temperature of the polyester polymer and to prevent spinning pressure from being increased by the amount of the polyester polymer discharged from a spinning machine, it is more preferred that a polyester polymer having an intrinsic viscosity of 2.0 dl/g or less is used.

Meanwhile, in order to solve the problem of high stiffness or the like when the polyester polymer (chip) is prepared as a polyester yarn and applied to the fabric for an airbag, the DEG content in the molecule of the polyester polymer may be 1.1 to 2.65 wt %, preferably 1.15 to 2.6 wt %, and more preferably 1.2 to 2.5 wt %. The DEG content in the molecule of the polyester polymer may be 1.1 wt % or more in terms of airbag folding property, and 2.65 wt % or less in terms of heat resistance.

Further, in order to maintain excellent physical properties even under conditions of high temperature and high humidity when the polyester yarn is prepared and applied to the fabric for an airbag, it is preferred that the DEG content in the molecule of the polyester polymer is optimized and the CEG content in the molecule of the polymer is maintained in the range of 40 meq/kg or less at the same time. Here, when the CEG content of the polyester polymer is maintained in a low range even after melt-spinning and drawing processes, the finally produced polyester yarn can preferably exhibit excellent physical properties such as high strength, excellent shape stability and mechanical properties under severe conditions. In this aspect, when the CEG content of the polyester polymer is more than 40 meq/kg, the CEG content in the molecule of the polyester yarn finally produced by melt-spinning and drawing processes is excessively increased to such a degree of more than 30 to 50 meq/kg, and an ester bond is cut by CEG under a condition of high humidity, thereby causing deterioration in the physical properties of the yarn itself and the fabric made therefrom.

Preferably, the polyester polymer includes poly(ethylene terephthalate) (PET) as a main component, and may include preferably 70 mol % or more, and more preferably 90 mol % or more thereof in order to secure mechanical properties as the yarn for the airbag.

Meanwhile, in the method for producing the polyester yarn of the present invention, the polyester polymer having high intrinsic viscosity and low CEG content is melt-spun to prepare an undrawn polyester yarn.

In this case, in order to obtain an undrawn polyester yarn having a low initial modulus and high diethylene glycol content, the melt-spinning process may be preferably performed at low temperature such that the thermal decomposition of the polyester polymer is minimized. Particularly, in order to minimize the deterioration in physical properties such as intrinsic viscosity and DEG and CEG contents of the high-viscosity polyester polymer, that is, in order to maintain high viscosity and high DEG content and low CEG content of the polyester polymer, the spinning process may be performed at a low temperature, for example, 270 to 310° C., preferably 280 to 300° C., and more preferably 282 to 298° C. Here, spinning temperature designates the extruder's temperature. When the melt-spinning process is performed at higher than 310° C., a large amount of the polyester polymer is thermally decomposed, and thus the intrinsic viscosity thereof becomes low, resulting in a decrease in the molecular weight thereof and an increase in the CET content thereof. Undesirably, the physical properties of the yarn can be deteriorated by the surface damage of the yarn. In contrast, when the melt-spinning process is performed at lower than 270° C., it is difficult to melt the polyester polymer, and the spinnability may be deteriorated due to N/Z surface cooling. Therefore, it is preferred that the melt-spinning process is performed in the above temperature range.

From the test results, it was found that, when the melt-spinning process of the polyester polymer is performed at such a low temperature, the decomposition of the polyester polymer is minimized to maintain high viscosity and high molecular weight, and thus a high-strength polyester yarn can be obtained in a subsequent drawing process without applying a high draw ratio, and therefore, the modulus thereof can be effectively lowered by the low drawing process, thereby obtaining a polyester yarn satisfying the above-mentioned physical properties.

Further, in the melt-spinning process, the spinning rate of the polyester polymer can be adjusted, for example, in the range of 300 to 1,000 m/min, and preferably 350 to 700 m/min in order to perform the melt-spinning process under low spinning tension, that is, in order to minimize spinning tension, in terms of minimizing the decomposition of the polyester polymer. As such, the process of melt-spinning the polyester polymer is selectively performed under a low spinning tension and a low spinning rate, so that the decomposition of the polyester polymer can be further minimized.

Meanwhile, the undrawn yarn obtained by such a melt-spinning process may have an intrinsic viscosity of 0.8 dl/g or more, or 0.8 to 1.2 dl/g, preferably 0.85 dl/g or more, or 0.85 to 1.2 dl/g, and more preferably 0.9 dl/g or more, or 0.90 to 1.2 dl/g. Further, the CEG content in the molecule of the undrawn yarn obtained by the low-temperature spinning may be 50 meq/kg or less, preferably 40 meq/kg or less, and more preferably 30 meq/kg or less. The CEG content in the molecule of the undrawn yarn can be maintained at the same level as that in the molecule of a drawn yarn obtained by performing a subsequent drawing process, that is, that in the molecule of a polyester yarn.

Particularly, as described above, when the thermal decomposition of the polyester polymer having high viscosity, high DEG content and low CEG content is suppressed by melt-spinning the polyester polymer under the condition of low temperature, the difference in intrinsic viscosity between the polyester polymer and the polyester yarn and the difference in CEG content therebetween can be minimized. For example, melt-spinning and subsequent processes may be performed such that the difference in intrinsic viscosity between the polyester polymer and the polyester yarn is 0.5 dl/g or less, or 0 to 0.5 dl/g, and preferably 0.4 dl/g or less, or 0.1 to 0.4 dl/g.

Further, the melt-spinning and subsequent processes may be performed such that the difference in the CEG content in the molecule between the polyester polymer and the polyester yarn is 20 meq/kg or less, or 0 to 20 meq/kg, and preferably 15 meq/kg or less, or 3 to 15 meq/kg.

As such, in the present invention, when the decrease in intrinsic viscosity of the polyester polymer and the increase in CEG content thereof are suppressed to the highest degree, excellent mechanical properties of the polyester yarn can be maintained, and simultaneously high elongation thereof can be secured, thereby producing a high-strength and low-modulus polyester yarn suitable for a fabric for an airbag.

It is preferred that the polyester polymer, for example, PET chip is spun by a spinning nozzle designed such that the monofilament fineness is 0.5 to 20 denier, and preferably 1 to 15 denier. That is, it is preferred that the monofilament fineness must be 1.5 denier or more in order to reduce the possibility of a monofilament being cut during spinning and the possibility of a monofilament being cut by interference during cooling, and that the monofilament fineness must be 15 denier or less in order to increase cooling efficiency.

Further, after the polyester polymer is melt-spun, a cooling process is performed to prepare an undrawn polyester yarn. The cooling process may be preferably performed by applying cooling air at 15 to 60° C., and the flow rate of the cooling air may be preferably adjusted to 0.4 to 1.5 m/s at each cooling air temperature. By this means, an undrawn polyester yarn having physical properties according to an embodiment of the present invention can be more easily prepared.

Meanwhile, after an undrawn polyester yarn is prepared by the spinning step, the prepared undrawn yarn is drawn to produce a drawn yarn. In this case, the drawing process may be performed under a condition of a draw ratio of 5.0 to 6.0, and preferably 5.0 to 5.8. The undrawn polyester yarn is present in a state in which the high intrinsic viscosity and low initial modulus thereof are maintained and the CEG content in the molecule thereof is minimized by optimization of melt-spinning process. Therefore, when the drawing process is performed at a high draw ratio of more than 6.0, the undrawn polyester yarn is excessively drawn, so that the produced drawn yarn may be cut or mowed and may have low elongation and high modulus because of high fiber orientation. Particularly, in the case where the elongation of the yarn decreases and the modulus thereof increases at such a high draw ratio, the folding and packing properties may become poor when this polyester yarn is applied to a fabric for an airbag. Conversely, when the drawing process is performed at a relatively low draw ratio, the strength of the produced polyester yarn may partially decrease due to low fiber orientation. However, in terms of physical properties, when the drawing process is performed at a draw ratio of 5.0 or more, it is possible to produce a high-strength and low-modulus polyester yarn suitable for being applied to a fabric for an airbag. Therefore, it is preferred that the drawing process is performed at a draw ratio of 5.0 to 6.5.

According to another proper embodiment of the present invention, the method of preparing the polyester fiber may include the drawing, thermally fixing, relaxing, and winding processes through multi-step godet rollers from the melt-spinning process of the high viscosity polyester polymer chip to the winding process by the winder, in order to produce the polyester yarn satisfying high strength and low contraction and having low modulus by direct spinning and drawing processes.

The drawing process may be performed after passing the undrawn polyester yarn through a godet roller with an oil pickup amount of 0.2% to 2.0%.

In the relaxation process, the relaxation ratio may be preferably 1% to 10%, and more preferably 1.1% to 9.0%. When the relaxation ratio thereof is less than 1.0%, high tension is applied to the yarn to cut the yarn. When the relaxation ratio thereof is more than 10.0%, it is difficult to achieve high contraction rate, and thus excellent gas barrier effect cannot be obtained during manufacture of the fabric for an airbag.

Meanwhile, in the drawing process, a heat fixation process of heat-treating the undrawn yarn at a temperature of 170 to 250° C. may be additionally performed. Preferably, for the proper drawing process, the undrawn polyester yarn may be heat-treated at a temperature of 175 to 250° C., and more preferably 180 to 245° C. Here, when the temperature is lower than 170° C., thermal effects are insufficient, and the relaxation efficiency becomes low, and thus it is difficult to realize an appropriate contraction rate. When the temperature is higher than 250° C., the strength of the yarn is deteriorated by the thermal decomposition and tar is formed on a roller, thus deteriorating workability.

In this case, the winding speed may be 2,000 to 4,000 m/min, and preferably 2,500 to 3,700 m/min.

Still another embodiment of the present invention provides a polyester fabric for an airbag including the above-mentioned polyester yarn.

In the present invention, the term "fabric for an airbag" refers to "a fabric or nonwoven fabric" used to manufacture an airbag for vehicles, and is characterized in that it is manufactured using the polyester yarn produced by the above process.

Particularly, in the present invention, when a low-modulus polyester yarn with high strength and high elongation and the optimized diethylene glycol content is used instead of the conventional high-modulus polyester fabric with high strength and low elongation, a polyester fabric for an airbag, which has high energy absorbing ability at the time of an airbag being expanded, excellent shape stability, air blocking effects, folding property, flexibility and packing property, can be manufactured. Further, the fabric for an airbag has excellent physical properties at room temperature, and can maintain excellent mechanical properties and air-tightness under severe conditions of high temperature and high humidity even after it is aged.

More particularly, the tensile strength of the fabric for an airbag of the present invention that is measured at room temperature according to the ASTM D 5034 method (standard of the American Society for Testing and Materials) may be 220 kgf/inch or more, or 220 to 350 kgf/inch, and preferably 230 kgf/inch or more, or 230 to 300 kgf/inch. It is preferable that the tensile strength is 220 kgf/inch or more in terms of the properties required for prior airbags. It is also preferable that the tensile strength is 350 kgf/inch or less in terms of practical property exhibition.

The breaking elongation of the fabric for an airbag that is measured according to the ASTM D 5034 method (standard of the American Society for Testing and Materials) at room temperature may be 20% or more, or 20% to 60%, and preferably 30% or more, or 30% to 50%. It is preferable that the breaking elongation is 20% or more in terms of the properties required for prior airbags. It is also preferable that the breaking elongation is 60% or less in terms of practical property exhibition.

Furthermore, because the coated fabric for an airbag expands rapidly by the gas of a high temperature and high pressure, superior tear strength is required. Therefore, the tear strength that represents the burst strength of the coated fabric for an airbag may be 23 kgf or more, or 23 to 60 kgf, and preferably 25 kgf or more, or 25 to 55 kgf when it is measured according to the ASTM D 2261 method (standard of the American Society for Testing and Materials) at room temperature. If the tear strength of the coated fabric is below the lowest limit, that is, below 23 kgf, at room temperature, the airbag may burst during the expansion thereof and it may cause a huge danger in function of the airbag.

The warp-wise and weft-wise shrinkage rates of the fabric for an airbag according to the present invention that are measured according to ASTM D 1776 method may be 4.0% or less, and preferably 2.0% or less, respectively. It is most preferable that the warp-wise and weft-wise shrinkage rates do not exceed 1.0%, in terms of securing the superior shape stability of the fabric.

The air permeability of the fabric that is measured according to ASTM D 737 method (standard of the American Society for Testing and Materials) at room temperature may be 10.0 cfm or less, or 0 to 10.0 cfm. Particularly, the air permeability of the fabric for an airbag can be apparently lowered by forming a coating layer of a rubber material on the fabric, which is possible to lower the air permeability to near 0 cfm. However, unless the rubber-material is coated thereon, the air permeability of the non-coated fabric of the present invention that is measured according to the ASTM D 737 method (standard of the American Society for Testing and Materials) at room temperature may be 10.0 cfm or less, or 0 to 10.0 cfm, preferably 3.5 cfm or less, or 0.1 to 3.5 cfm, and more preferably 1.5 cfm or less, or 0.5 to 1.5 cfm. If the air permeability is over 10.0 cfm, and more preferably over 3.5 cfm, it may be undesirable in terms of maintaining the air-tightness of the fabric for an airbag.

Furthermore, the stiffness of the fabric for an airbag of the present invention that is measured according to the ASTM D 4032 method (standard of the American Society for Testing and Materials) at room temperature may be 0.2 kgf or more, or 0.2 to 1.2 kgf, and preferably 0.5 kgf or more, or 0.5 to 1.0 kgf. Particularly, the stiffness may be 1.2 kgf or less when the fiber is 530 denier or more, and the stiffness may be 0.8 kgf or less when the fiber is less than 460 denier.

It is preferable that the fabric of the present invention maintains its stiffness in the above range, in order to effectively use it for an airbag. If the stiffness is too low such as below 0.2 kgf, it may not function as a sufficient protecting support when the airbag is expanded, and packing property may also be deteriorated when it is installed in a vehicle because its shape stability deteriorates. Furthermore, in order to prevent the fabric from becoming too rigid to fold, to prevent the packing property from being deteriorated, and to prevent the fabric from being discolored, the stiffness may preferably be 1.2 kgf or less. Particularly, the stiffness may be preferably 0.8 kgf or less in the case of being 460 denier or less, and 1.2 kgf or less in the case of being 530 denier or more.

As described above, because the polyester fabric is produced by using the low-modulus yarn with high strength and high elongation to show excellent contraction properties, the fabric has excellent edgecomb resistance to improve mechanical properties, energy absorbing ability for high-temperature and high-pressure gas, and folding property of the final fabric at the same time. Particularly, the edgecomb resistance of the polyester fabric of the present invention that is measured according to the ASTM D 6479 method (standard of the American Society for Testing and Materials) at room temperature (25° C.) may be 350 N or more, or 350 to 1000 N, and preferably 380 N or more, or 380 to 970 N. Further, the edgecomb resistance of the polyester fabric that is measured at 90° C. may be 300 N or more, or 300 to 970 N, and preferably 320 N or more, or 320 to 950 N. In this case, when each of the edgecomb resistance of the polyester fabric that is measured at room temperature (25° C.) and 90° C. is less than 350 N and 300 N, abrupt deterioration of the strength along the seam line of the airbag cushion undesirably occurs in the event of airbag unfolding, so that the fabric is susceptible to rupture due to occurrence of pin holes and seam puckering during the airbag unfolding.

Further, the fabric may have strength retention of 90% or more after long-term aging.

Still another embodiment of the present invention provides a method of producing a fabric for an airbag by using the polyester fiber. The method of producing the fabric for an airbag of the present invention includes the steps of weaving a raw fabric for an airbag using the polyester yarns, scouring the woven raw fabric for an airbag, and tentering the scoured fabric.

In the present invention, the polyester yarn may be formed into the final fabric for an airbag by the typical weaving, scouring and tentering processes. In this case, the weaving shape of the polyester fabric is not particularly limited. Preferably, the polyester fabric may be a plain-woven type fabric or a one-piece-woven (OPW) type fabric.

Particularly, the fabric for an airbag of the present invention may be manufactured by performing beaming, weaving, scouring and tentering processes using the polyester yarn as a warp and a weft. The fabric may be manufactured using a general weaving machine, and the kind of the weaving machine is not limited. Preferably, the plain-woven type fabric may be manufactured using a Rapier loom, an air jet loom or a water jet loom, and the OPW type fabric may be manufactured using a Jacquard loom.

Furthermore, it is preferable that the fabric for an airbag of the present invention further includes a coating layer coated or laminated on the surface with one or more selected from the group consisting of silicone resin, polyvinylchloride resin, polyethylene resin, polyurethane resin or the like, but the kind of coating resin is not limited to the materials mentioned above. The resin coated layer may be formed by a knife-over-roll coating method, a doctor blade method, or a spray coating method, but it is not limited to the methods mentioned above.

The amount of the coated resin per unit area of the coating layer may be 20 to 200 g/m$^2$, and preferably 20 to 100 g/m$^2$. Particularly, the amount of the coated resin is preferably 30 g/m$^2$ to 95 g/m$^2$ in the case of the OPW (One Piece Woven) type fabric for a side curtain airbag, and preferably 20 g/m$^2$ to 50 g/m$^2$ in the case of the plain type fabric for an airbag.

The coated fabric for an airbag may be formed into an airbag cushion having a certain shape through the processes of tailoring and sewing. The airbag is not limited to any particular shape, and can be prepared in a general form.

Meanwhile, still another embodiment of the present invention provides an airbag system including the airbag. The airbag system may be equipped with a general apparatus that is well known to those skilled in the art. The airbags may be largely classified into frontal airbags and side curtain airbags. The frontal airbags includes an airbag for a driver seat, an airbag for a passenger seat, an airbag for side protection, an airbag for knee protection, an airbag for ankle protection, an airbag for pedestrian protection, and the like. The side curtain airbags are used to protect an occupant at the time of side collision and overturn of a vehicle. Therefore, the airbag of the present invention may be a frontal airbag or a side curtain airbag.

In the present invention, matters other than the above-mentioned contents are not particularly limited because they can be added or omitted according to circumstances.

Effects Of The Invention

According to the present invention, there is provided a polyester yarn for an airbag, which has a diethylene glycol content and an initial modulus optimized in a predetermined range, and thus can be used for producing a fabric for an airbag having excellent mechanical properties, flexibility and folding property, a low reduction in physical properties during long-term storage, and excellent edgecomb resistance.

This polyester yarn for an airbag is optimized to have a high diethylene glycol content and a low modulus, thereby showing high strength, high elongation and high contraction rate. Thus, when the yarn is used in the fabric for an airbag, excellent shape stability, mechanical properties, and gas barrier effect can be obtained, and excellent folding property and flexibility can be also secured at the same time. Accordingly, when the airbag is mounted in a vehicle, the packing property is remarkably improved, the reduction in physical properties is lowered during long-term storage, and less damage is caused upon unfolding the airbag, and the impact applied to an occupant is minimized, thereby protecting occupant safely.

Therefore, the polyester yarn of the present invention and the polyester fabric produced using the same can be very preferably used to manufacture an airbag for a vehicle.

Best Mode For Invention

Hereinafter, the preferred Examples are provided for better understanding of the present invention. However, the following Examples are for illustrative purposes only, and the present invention is not intended to be limited by the following Examples.

EXAMPLES 1-5

According to the processing conditions shown in the following Table 1, esterification reaction of terephthalic acid and ethylene glycol was carried out and polycondensation reaction of the prepared oligomers was carried out so as to prepare polymers.

Under the circumstances, the polymer produced through the polycondensation was further reacted with ethylene glycol that was further introduced in an amount of 1% and 3%, based on the total amount of the glycol initially introduced, respectively, at normal pressure. In this regard, the additional reaction was performed so that the intrinsic viscosity (IV) of the melt-polymerized polyester polymers (raw chips) prepared through the additional reactions became about 0.5-0.8 dl/g.

Furthermore, in order to increase the specific surface area, the polyester polymer (raw chip) prepared by the polycondensation reactions and the additional reactions was cut into a size of 2.0 g/100 ea, and then solid state polymerization reaction was carried out at the temperature range of 220-245° C. so as to prepare the SSP polyester chips having the intrinsic viscosity (IV) of 0.7-1.3 dl/g.

The SSP polyester chips, namely, PET polymers were melt-spun and cooled under the process conditions as shown in the following Table 1, so as to prepare an undrawn polyester yarn, and then the undrawn yarn was drawn at a predetermined draw ratio and heat-treated to produce a polyester yarn. In this case, the mole ratio of glycol/dicarboxylic acid, the temperature, the pressure, and the reaction time of esterification reaction, the polycondensation reaction, the additional reaction for introducing glycol, and solid state polymerization reaction, the intrinsic viscosity of PET polymer and the DEG/CEG contents in the molecule, the spinning temperature of the melt-spinning process, the draw ratio, the heat-treating temperature or the like are given in Table 1 below, and other conditions were based on general conditions for producing a polyester yarn.

TABLE 1

| | Example 1 | Example 2 | Example 3 | Example 4 | Example 5 |
|---|---|---|---|---|---|
| Mole ratio of glycol/dicarboxylic acid | 1.12 | 1.14 | 1.2 | 1.3 | 1.4 |
| Esterification temperature (° C.) | 290 | 292 | 288 | 285 | 280 |

TABLE 1-continued

| | Example 1 | Example 2 | Example 3 | Example 4 | Example 5 |
|---|---|---|---|---|---|
| Esterification time (hr) | 3.8 | 3.6 | 3.4 | 3.1 | 2.9 |
| Polycondensation temperature (° C.) | 305 | 300 | 298 | 295 | 290 |
| Polycondensation time (hours) | 3.5 | 3.3 | 3.0 | 2.9 | 2.8 |
| Vacuum degree of polycondensation (Torr) | 1 | 1.2 | 1.3 | 1.1 | 1.1 |
| Additional introduction/initial introduction of glycol (%) | 2.8 | 2.5 | 2.2 | 2.0 | 1.5 |
| Raw Chip IV (dl/g) | 0.65 | 0.67 | 0.68 | 0.70 | 0.69 |
| Solid state polymerization temperature (° C.) | 245 | 243 | 240 | 237 | 235 |
| Solid state polymerization time (hours) | 24 | 25 | 26 | 29 | 30 |
| Vacuum degree of Solid state polymerization (Torr) | 1.0 | 0.8 | 0.7 | 1.0 | 0.8 |
| IV (dl/g) after solid state polymerization | 1.3 | 1.4 | 1.35 | 1.38 | 1.41 |
| DEG of chip (wt %) | 1.2 | 1.5 | 1.8 | 2.0 | 2.4 |
| CEG of chip (meq/kg) | 38 | 30 | 25 | 22 | 19 |
| Spinning temperature (° C.) | 299 | 298 | 297 | 295 | 292 |
| Draw ratio | 5.4 | 5.5 | 5.7 | 5.8 | 5.8 |
| Heat treatment temperature (° C.) | 242 | 244 | 245 | 246 | 247 |

The physical properties of the polyester yarns produced in Examples 1 to 5 were measured using the following method, and the measured physical properties thereof are given in Table 2 below.

1) Crystallinity

The density (p) of the polyester yarn was measured at 25° C. by a density gradient tube method using n-haptane and carbon tetrachloride, and the crystallinity was calculated by the following Calculation Formula 1 below:

$$X_c(\text{crystallinity}) = \frac{\rho_c(\rho - \rho_a)}{\rho(\rho_c - \rho_a)} \quad \text{[Calculation Formula 1]}$$

wherein ρ is density of yarn, $\rho_c$ is density of crystal (in the case of PET, 1.457 g/cm$^3$), and $\rho_a$ is density of noncrystal (in the case of PET, 1.336 g/cm$^3$).

2) Intrinsic Viscosity

An emulsion was extracted from a sample using carbon tetrachloride, the sample was melted by OCP (ortho-chloro phenol) at 160±2° C., and then the viscosity of the sample in a viscosity tube was measured at 25° C. using an automatic viscometer (Skyvis-4000). The intrinsic viscosity (IV) of the polyester yarn was calculated by Calculation Formula 2 below:

$$\text{Intrinsic viscosity (IV)} = \{(0.0242 \times \text{Rel}) + 0.2634\} \times F \quad \text{[Calculation Formula 3]}$$

wherein Rel=(seconds of solution×specific gravity of solution×viscosity coefficient)/(OCP viscosity) and F=(IV of the standard chip)/(average of three IV measured from the standard chip with standard action)

3) CEG Content and DEG Content

The CEG (carboxyl end group) content of the polyester yarn was measured according to ASTM D 664 and D 4094, in which 0.2 g of a sample was put into a 50 mL triangle flask, 20 mL of benzyl alcohol was added to the sample, the temperature was increased to 180° C. using a hot plate and then left for 5 minutes at the same temperature to completely dissolve the sample. Then, the solution was cooled to 160° C., 5-6 drops of phenolphthalein were applied to the solution when the temperature reached 135° C., and then the solution was titrated with 0.02 N KOH to change the colorless solution into the pink solution. At this titration point, the CEG content (—COOH, million equiv./sample kg) was calculated by Calculation Formula 3 below:

$$\text{CEG} = (A - B) \times 20 \times 1/W \quad \text{[Calculation Formula 3]}$$

wherein A is the amount (mL) of KOH consumed in the titration of a sample, B is the amount (mL) of KOH consumed in a blank sample, and W is the weight (g) of a sample.

For measurement of the DEG (diethylene glycol) content, 1 g of a sample was put into a 50 mL vessel, 3 mL of monoethanolamine was added to the sample, and heated using a hot plate to completely dissolve the sample. Then, the solution was cooled to 100° C., 0.005 g of 1,6-hexanediol in 20 mL of methanol was added, and 10 g of terephthalic acid was added to neutralize the solution. The resulting neutralized solution was filtered using a funnel and a filter paper, and the filtrate was subjected to gas chromatography to measure the DEG content (% by weight). GC analysis was performed using a Shimadzu GC analyzer in accordance with the Shimadzu GC manual.

4) Initial Modulus

According to the ASTM D 885 method (standard of the American Society for Testing and Materials), the initial modulus was measured by calculating a coefficient value of elasticity from the slope in the linear elastic region of the stress-strain curve obtained by a tensile test.

5) Tensile Strength and Breaking Elongation

The tensile strength and breaking elongation of the polyester yarn were measured using a universal material testing machine (Instron) under conditions of a gauge length of 250 mm, a tension rate of 300 mm/min and an initial load of 0.05 g/d. A rubber faced grip was used for measurement.

6) Dry Contraction Rate

The dry contraction rate was measured at a temperature of 180° C. and a tension of 30 g for 2 minutes using a Testrite MK-V (manufactured by Testrite Corporation, England).

7) Toughness

The toughness ($10^{-1}$ g/d) was calculated by Calculation Formula 4 below:

$$\text{Toughness}=\frac{\text{Strenegth}}{(\text{g/d})\times\sqrt{\text{ElongationatBreak}(\%)}} \quad \text{[Calculation Formula 4]}$$

8) Single Yarn Fineness

The single yarn fineness was measured according to the method of picking the yarn of 9,000 m by using a reel, weighing the yarn to obtain the total fineness (denier) of the fiber, and dividing the total fineness by the number of filaments.

9) Elongation

Measurement was performed in the same manner as in the measurement of tensile strength and the breaking elongation, and the elongation value corresponding to each load was identified in the S-S Curve.

TABLE 2

| | | Example 1 | Example 2 | Example 3 | Example 4 | Example 5 |
|---|---|---|---|---|---|---|
| Crystallinity (%) | | 45.5 | 45.0 | 44.7 | 44.5 | 44.3 |
| Intrinsic viscosity of yarn (dl/g) | | 1.01 | 1.03 | 1.07 | 1.06 | 1.10 |
| DEG of yarn (wt %) | | 1.2 | 1.5 | 1.8 | 2.0 | 2.4 |
| CEG of yarn (meq/kg) | | 20 | 19 | 18 | 16 | 14 |
| Initial modulus (g/d) | | 95 | 90 | 88 | 80 | 75 |
| Tensile strength (g/d) | | 9.0 | 9.2 | 9.0 | 9.1 | 9.1 |
| Breaking elongation (%) | | 19 | 22 | 23 | 22 | 20 |
| Dry contraction rate (%) | | 4.2 | 4.7 | 5.3 | 5.8 | 6.5 |
| Single yarn fineness (de) | | 7.7 | 7.7 | 8.3 | 4.2 | 4.7 |
| Total fineness (de) | | 460 | 460 | 500 | 500 | 460 |
| Number of filament | | 60 | 60 | 60 | 120 | 120 |
| Elongation (%) | At the stress of 1.0 g/d | 0.7 | 0.74 | 0.76 | 0.82 | 0.90 |
| | At the stress of 4.0 g/d | 7.0 | 7.6 | 8.0 | 8.5 | 9.6 |
| | At the stress of 7.0 g/d | 10.6 | 11.7 | 12.4 | 13.6 | 14.5 |

COMPARATIVE EXAMPLES 1-5

Polyester yarns of Comparative Examples 1-5 were manufactured in the same manner as in Examples 1-5, except for the conditions given in Table 3 below.

TABLE 3

| | Comparative Example 1 | Comparative Example 2 | Comparative Example 3 | Comparative Example 4 | Comparative Example 5 |
|---|---|---|---|---|---|
| Mole ratio of glycol/dicarboxylic acid | 1.09 | 1.10 | 1.11 | 1.5 | 1.6 |
| Esterification temperature (° C.) | 290 | 288 | 284 | 279 | 278 |
| Esterification time (hr) | 4.2 | 4.1 | 4.0 | 2.4 | 2.3 |
| Polycondensation temperature (° C.) | 312 | 311 | 311 | 280 | 285 |
| Polycondensation time (hours) | 4.4 | 4.2 | 4.0 | 2.8 | 2.9 |
| Vacuum degree of polycondensation (Torr) | 1 | 1.2 | 1.3 | 1.2 | 1.4 |
| Additional introduction/initial introduction of glycol (%) | 3.9 | 3.5 | 3.1 | 0.9 | 0.5 |
| IV (dl/g) of Raw Chip | 0.65 | 0.70 | 0.68 | 0.70 | 0.72 |
| Solid state polymerization temperature (° C.) | 246 | 245 | 244 | 235 | 233 |
| Solid state polymerization time (hours) | 21 | 22 | 24 | 33 | 35 |
| Vacuum degree of solid state polymerization (Torr) | 1.0 | 0.8 | 0.7 | 1.0 | 0.8 |
| IV (dl/g) after solid state polymerization | 1.1 | 1.2 | 1.2 | 1.38 | 1.41 |
| DEG of chip (wt %) | 0.55 | 0.67 | 0.8 | 2.7 | 3.0 |
| CEG of chip (meq/kg) | 55 | 53 | 52 | 15 | 14 |
| Spinning temperature (° C.) | 298 | 297 | 296 | 292 | 290 |

TABLE 3-continued

| | Comparative Example 1 | Comparative Example 2 | Comparative Example 3 | Comparative Example 4 | Comparative Example 5 |
|---|---|---|---|---|---|
| Draw ratio | 6.0 | 6.1 | 6.1 | 6.3 | 6.4 |
| Heat treatment temperature (° C.) | 210 | 220 | 220 | 246 | 247 |

The physical properties of the polyester yarns produced in Comparative Examples 1-5 are summarized in Table 4 below.

TABLE 4

| | | Comparative Example 1 | Comparative Example 2 | Comparative Example 3 | Comparative Example 4 | Comparative Example 5 |
|---|---|---|---|---|---|---|
| Crystallinity (%) | | 44.5 | 44.0 | 44.7 | 42.1 | 42.0 |
| Intrinsic viscosity of yarn (dl/g) | | 0.98 | 0.99 | 0.98 | 0.98 | 0.99 |
| DEG of yarn (wt %) | | 0.55 | 0.67 | 0.8 | 2.7 | 3.0 |
| CEG of yarn (meq/kg) | | 46 | 42 | 44 | 18 | 16 |
| Initial modulus (g/d) | | 101 | 103 | 105 | 106 | 108 |
| Tensile strength (g/d) | | 9.0 | 9.2 | 9.0 | 9.1 | 9.1 |
| Breaking elongation (%) | | 13.5 | 13.7 | 13.2 | 13.8 | 13.8 |
| Dry contraction rate (%) | | 12.0 | 12.2 | 12.4 | 12.5 | 12.6 |
| Single yarn fineness (de) | | 1.25 | 6.0 | 6.0 | 3.0 | 3.3 |
| Total fineness (de) | | 200 | 240 | 600 | 700 | 800 |
| Number of filament | | 160 | 40 | 50 | 230 | 240 |
| Elongation (%) | At the stress of 1.0 g/d | 0.41 | 0.43 | 0.44 | 0.46 | 0.48 |
| | At the stress of 4.5 g/d | 3.6 | 3.8 | 3.9 | 4.0 | 4.1 |
| | At the stress of 7.0 g/d | 7.0 | 7.1 | 7.4 | 7.3 | 7.4 |

PREPARATION EXAMPLES 1-5

Raw fabrics for an airbag was woven from the polyester yarns prepared according to Examples 1-5 by using a Rapier Loom, and were prepared into fabrics for an airbag through the scouring and tentering processes. Then, a polyvinylchloride (PVC) resin was coated on the fabrics with a knife-over-roll coating method to obtain PVC coated fabrics.

In this case, the warp weaving density and weft weaving density, weaving shape and resin coating amount of the yarn are given in Table 5 below, and other conditions were based on general conditions for producing a polyester fabric.

TABLE 5

| | | Example 1 | Example 2 | Example 3 | Example 4 | Example 5 |
|---|---|---|---|---|---|---|
| Weaving density (warp × weft) | warp | 53 | 53 | 53 | 53 | 53 |
| | weft | 53 | 53 | 53 | 53 | 53 |
| Weaving shape (Plain/opw) | | Plain | Plain | Plain | Plain | Plain |
| Resin coating amount (g/m$^2$) | | 25 | 25 | 25 | 25 | 25 |

The physical properties of the polyester fabrics for an airbag, manufactured using the polyester yarns of Examples 1-5, were measured using the following method, and the results thereof are given in Table 6 below.

(a) Tensile Strength and Breaking Elongation

The fabric sample was cut from the fabric for an airbag, and fixed at the lower clamp of the apparatus for measuring the tensile strength according to ASTM D 5034 (standard of the American Society for Testing and Materials). Thereafter, while moving the upper clamp upwardly, the tensile strength and the elongation at the time when the fabric sample was broken were measured.

(b) Tear Strength

The tearing strength of the fabric for an airbag was measured according to ASTM D 2261 (standard of the American Society for Testing and Materials).

(c) Warpwise and Weftwise Contraction Rates

The warpwise and weftwise contraction rates of the polyester fabric were measured according to ASTM D 1776 (standard of the American Society for Testing and Materials). First, a sample is cut from the fabric for an airbag to a length of 20 cm which is a length before warpwise and weftwise contraction, and then heat-treated in a chamber at 149° C. for 1 hour, and then the length thereof was measured. Based on this measured length, the warpwise and weftwise contraction ratios {(length before contracted−length after contracted)/length before contracted×100%} were measured.

(d) Stiffness

The stiffness of the fabric was measured by a circular bend method using a stiffness tester according to ASTM D 4032 (standard of the American Society for Testing and Materials). Further, the stiffness thereof may be measured by a cantilever method. The stiffness thereof may be measured by measuring the length of the bent fabric using a cantilever meter which is a tester inclined at a predetermined angle in order to bend the fabric.

(e) Thickness

The thickness of the fabric for an airbag was measured according to ASTM D 1777 (standard of the American Society for Testing and Materials).

(f) Air Permeability

The amount of air permeating the circular section (area: 38 cm$^2$) of a fabric for an airbag was measured after leaving the fabric under conditions of 20° C. and 65% RH for 1 day or more according to ASTM D 737 (standard of the American Society for Testing and Materials).

(g) Edgecomb Resistance

The edgecomb resistance of the fabric, which was a noncoated fabric before coating treatment, were measured by the method according to ASTM D 6479 (standard of the American Society for Testing and Materials) at room temperature (25° C.) and 90° C., respectively.

TABLE 6

| | Example 1 | Example 2 | Example 3 | Example 4 | Example 5 |
|---|---|---|---|---|---|
| Tensile strength (kgf/inch) | 243 | 242 | 242 | 244 | 245 |
| Breaking elongation (%) | 40 | 42 | 38 | 40 | 41 |
| Tear strength (kgf) | 20 | 21 | 21 | 20 | 21 |
| Tensile strength after aging at 85° C. for 3,000 hours (kgf/inch) | 242 | 240 | 240 | 241 | 242 |
| Strength retention | 99.6 | 99.2 | 99.2 | 98.9 | 98.9 |
| Breaking elongation after aging at 85° C. for 3,000 hours (%) | 42 | 41 | 39 | 39 | 40 |
| Stiffness (kgf) | 0.45 | 0.50 | 0.47 | 0.43 | 0.43 |
| Air permeability (cfm) | 0.8 | 0.8 | 0.8 | 0.7 | 0.7 |
| Edgecomb (N) | 601 | 605 | 607 | 610 | 615 |

COMPARATIVE PREPARATION EXAMPLES 1-5

Polyester fabrics for an airbag were produced in the same manner as in Preparation Examples 1-5, except for using the polyester yarns produced in Comparative Examples 1-5, and the physical properties thereof were measured, and the results thereof are given in Table 7 below.

TABLE 7

| | Comparative Example 1 | Comparative Example 2 | Comparative Example 3 | Comparative Example 4 | Comparative Example 5 |
|---|---|---|---|---|---|
| Tensile strength (kgf/inch) | 233 | 232 | 232 | 239 | 235 |
| Breaking elongation (%) | 35 | 32 | 28 | 30 | 31 |
| Tear strength (kgf) | 16 | 17 | 17 | 16 | 18 |
| Tensile strength after aging at 85° C. for 3,000 hours (kgf/inch) | 203 | 202 | 202 | 212 | 211 |
| Strength retention | 87.1 | 87.1 | 87.1 | 88.7 | 89.8 |
| Breaking elongation after aging at 85° C. for 3,000 hours (%) | 25 | 22 | 18 | 20 | 21 |
| Stiffness (kgf) | 1.2 | 1.2 | 1.1 | 1.1 | 1.1 |
| Air permeability (cfm) | 1.8 | 1.8 | 1.7 | 1.9 | 2.0 |
| Edgecomb (N) | 301 | 305 | 307 | 310 | 315 |

As shown in Table 6, it can be recognized that the fabrics for an airbag of Preparation Examples 1-5, which were prepared from the polyester yarns of Examples 1-5 having the optimized diethylene glycol content and low initial modulus, showed remarkably improved strength retention during long-term aging and high edgecomb resistance, excellent air permeability, high flexibility due to low stiffness. Particularly, the fabrics for an airbag of Preparation Examples 1-5 maintained the tensile strength of 240 kgf or more after long-term aging, air permeability of 1.0 cfm or less, and also had stiffness of 0.5 or less to be very soft, indicating remarkably improved packing property. In addition, the fabrics maintained edgecomb resistance of 600 N or more, suggesting that rupture of the airbag can be prevented upon unfolding the airbag.

On the contrary, as shown in Table 7, it is recognized that the fabrics for an airbag of Comparative Preparation Examples 1-5 that were prepared by using the polyester yarns of Comparative Examples 1-5 do not satisfy such characteristics. Particularly, the fabrics showed low strength retention during long-term aging and low edgecomb resistance, remarkably reduced air permeability, and high stiffness. With respect to the fabrics for an airbag of Comparative Preparation Examples 1-3, the tensile strength after long-term aging was remarkably reduced from 230 kgf to 200 kgf, and the air permeability was maintained 1.0 cfm or more, and the stiffness was also as high as 1.0 or more to show very low packing property. The edgecomb resistance was also 300 N, and thus there may be a problem of an airbag being broken upon unfolding the airbag.

In the present invention, particularly, the diethylene glycol content of the polyester yarn is increased to obtain soft molecular chains, to lower the modulus and to minimize the CEG content, thereby minimizing a reduction in the physical properties after long-term aging under high-temperature and high-humidity conditions. The polyester yarn of the present invention has characteristics of the optimized diethylene glycol content and low modulus to secure excellent folding property and edgecomb resistance, and heat setting temperature is optimized during the reeling process of the yarn to secure improved heat resistance at the same time.

What is claimed:

1. A drawn polyester yarn having a diethylene glycol content of 1.1 to 2.65 wt %, an initial modulus of 75-100 g/d, and an intrinsic viscosity of 0.9-1.2 dl/g, wherein the polyester yarn is produced by a process comprising:

providing a polyester polymer chip having an intrinsic viscosity of 0.5-0.8 dl/g, subjecting the polyester polymer chip to a solid state polymerization to prepare a solid state polymerized polyester chip having an intrinsic viscosity of 0.90-2.0 dl/g, melt-spinning the solid state polymerized polyester chip to produce an undrawn polyester yarn, drawing the polyester yarn at a ratio of 5.0-5.8 at a winding speed of 2,000-4,000 m/min to obtain the drawn polyester yarn.

2. The drawn polyester yarn according to claim 1, wherein drawn the polyester yarn has a carboxyl end group content of 40 meq/kg or less.

3. The drawn polyester yarn according to claim 1, wherein the drawn polyester yarn has crystallinity of 40% to 55%.

4. The drawn polyester yarn according to claim 1, wherein the drawn polyester yarn has a tensile strength of 7.5-10.0 g/d and a breaking elongation of 13-35%.

5. The drawn polyester yarn according to claim 1, wherein the drawn polyester yarn has a dry contraction ratio of 4-12% and toughness of $30\times10^{-1}$ $-46\times10^{-1}$ g/d.

6. The drawn polyester yarn according to claim 1, wherein an elongation of the drawn polyester yarn is 0.5-1.5% at a stress of 1.0 g/d, 4.3-20% at a stress of 4.0 g/d, and 7.5-25% at a stress of 7.0 g/d, at room temperature.

7. The drawn polyester yarn according to claim 1, wherein the drawn yarn has a single yarn fineness of 0.5 to 20 denier.

8. The drawn polyester yarn according to claim 1, wherein the drawn yarn has a total fineness of 200 to 1,000 denier.

9. The drawn polyester yarn according to claim 1, wherein the drawn yarn has the number of filaments of 50 to 240.

10. A method for producing the drawn polyester yarn according to claim 1, comprising the steps of:

providing a polyester polymer chip having an intrinsic viscosity of 0.5-0.8 dl/g, subjecting the polyester polymer chip to a solid state polymerization to prepare a solid state polymerized polyester chip having an intrinsic viscosity of 0.90-2.0 dl/g, melt-spinning the solid state polymerized polyester polymer chip at 270 to 310° C. to produce an undrawn polyester yarn, and drawing the undrawn polyester yarn at a ratio of 5.0-5.8 at a winding speed of 2,000-4,000 m/min to obtain a drawn polyester yarn, wherein the drawn polyester yarn has a diethylene glycol content of 1.1 to 2.65 wt %, an initial modulus of 75-100 g/d, and an intrinsic viscosity of 0.9-1.2 dl/g.

11. The method according to claim 10, wherein the polyester polymer includes 70 mol % or more of poly (ethylene terephthalate).

12. The method according to claim 10, wherein the solid state polymerized polyester polymer chip has an intrinsic viscosity of 1.3 to 1.41 dl/g, and a difference of the intrinsic viscosity between the solid state polymerized polyester polymer chip and the yarn is 0.5 dl/g or less.

13. The method according to claim 10, wherein the polyester polymer has a carboxyl end group content of 30 meq/kg or less.

14. The method according to claim 10, wherein the difference in the carboxyl end group content between the polyester polymer and the yarn is 20 meq/kg or less.

15. The method according to claim 10, wherein the drawing process is carried out after passing the undrawn polyester yarn through a godet roller with an oil pickup amount of 0.2% to 2.0%.

16. The method according to claim 10, further comprising the step of performing a heat fixation process at a temperature of 170 to 250° C. after the step of drawing the undrawn yarn.

17. The polyester yarn according to claim 10, further comprising the step of performing a relaxation process at a relaxation ratio of 1% to 10% after the step of drawing the undrawn yarn.

18. The method according to claim 10, further comprising the step of performing a winding process at a winding speed of 2,000 to 4,000 m/min after the step of drawing the undrawn yarn.

19. A polyester fabric for an airbag, comprising the polyester yarn according to claim 1.

20. The polyester fabric for an airbag according to claim 19, wherein tear strength of the fabric measured according to the ASTM D 2261 method is 20 kgf or more.

21. The polyester fabric for an airbag according to claim 19, wherein air permeability of the fabric measured according to the ASTM D 737 method is 10.0 cfm or less.

22. The polyester fabric for an airbag according to claim 19, wherein stiffness of the fabric measured according to the ASTM D 4032 is 1.0 kgf or less.

23. The polyester fabric for an airbag according to claim 19, wherein the fabric has a strength retention of 90% or more after aging at 85° C. for 3.000 hours.

24. A drawn polyester yarn having a diethylene glycol content of 1.1 to 2.65 wt %, an initial modulus of 75-100 g/d, and an intrinsic viscosity of 1.01-1.2 dl/g, wherein the polyester yarn is produced by a process comprising:

melt-spinning a polyester chip having an intrinsic viscosity of 1.3-2.0 dl/g to produce an undrawn polyester yarn, drawing the polyester yarn at a ratio of 5.0-5.8 at a winding speed of 2,000-4,000 m/min to obtain the drawn polyester yarn.

* * * * *